US010544934B1

(12) United States Patent
Kennedy

(10) Patent No.: US 10,544,934 B1
(45) Date of Patent: Jan. 28, 2020

(54) ILLUMINATING HUB ASSEMBLY FOR A QUOIT BOARD

(71) Applicant: Nicholas A. Kennedy, Nazareth, PA (US)

(72) Inventor: Nicholas A. Kennedy, Nazareth, PA (US)

( * ) Notice: Subject to any disclaimer, the term of this patent is extended or adjusted under 35 U.S.C. 154(b) by 0 days.

(21) Appl. No.: 16/260,064

(22) Filed: Jan. 28, 2019

Related U.S. Application Data

(60) Provisional application No. 62/622,329, filed on Jan. 26, 2018.

(51) Int. Cl.

| | |
|---|---|
| ***F21V 33/00*** | (2006.01) |
| ***F21V 15/04*** | (2006.01) |
| ***A63B 67/06*** | (2006.01) |
| ***F21V 3/06*** | (2018.01) |
| ***F21Y 115/10*** | (2016.01) |
| ***F21V 21/04*** | (2006.01) |
| ***F21V 21/06*** | (2006.01) |
| ***F21V 21/02*** | (2006.01) |

(52) U.S. Cl.
CPC ..... *F21V 33/008* (2013.01); *A63B 67/06* (2013.01); *F21V 3/0625* (2018.02); *F21V 15/04* (2013.01); *A63B 2067/063* (2013.01); *F21V 21/02* (2013.01); *F21V 21/047* (2013.01); *F21V 21/06* (2013.01); *F21Y 2115/10* (2016.08)

(58) Field of Classification Search
CPC ..... F21V 21/02; F21V 21/047; F21V 21/06; F21V 33/008; F21V 19/0055; F21V 2200/40; A63B 2067/063
See application file for complete search history.

(56) References Cited

U.S. PATENT DOCUMENTS

| | | | | |
|---|---|---|---|---|
| 1,178,049 A * | 4/1916 | Beardsley | A63B 67/06 273/336 |
| 3,005,907 A * | 10/1961 | Dupree | B60Q 3/14 362/630 |
| 4,898,392 A * | 2/1990 | Goletz | A63B 63/08 273/123 R |
| 5,317,489 A * | 5/1994 | Delli Gatti | A63B 67/06 362/157 |
| 7,249,766 B1 * | 7/2007 | Kennedy | A63B 67/06 273/336 |

(Continued)

*Primary Examiner* — Alexander K Garlen
*Assistant Examiner* — Colin J Cattanach
(74) *Attorney, Agent, or Firm* — Clinton H. Wilkinson

(57) ABSTRACT

A quoit board hub assembly for a quoit board having a center pin which is selectively illuminating and formed of a translucent or transparent tubular member having a dome shaped end cap, and a light element mounted in the tubular pin member on a light element support and electrically coupled to a power source, the hub assembly also including a base flange adapter including a pin support section for supporting the tubular pin in an upright position in a central aperture in the quoit board, and including an alignment flange on an interior surface of the support section for properly locating the position of the tubular pin, and in an embodiment a cushioning member positioned between the outer surface of the tubular member and the central aperture in the board to further isolate and protect the light element from the forces exerted by the quoits on the central pin during game play.

11 Claims, 2 Drawing Sheets

(56) References Cited

U.S. PATENT DOCUMENTS

| | | | | |
|---|---|---|---|---|
| 8,162,318 | B1 * | 4/2012 | Peterson | A63B 67/06 273/343 |
| 8,282,256 | B1 * | 10/2012 | Pike | A47G 33/06 362/554 |
| 2005/0007791 | A1 * | 1/2005 | Helbach | F21S 8/02 362/555 |
| 2005/0018439 | A1 * | 1/2005 | Schevardo | B64D 11/00 362/471 |
| 2006/0050527 | A1 * | 3/2006 | Rehberger | F21V 31/005 362/555 |
| 2006/0108741 | A1 * | 5/2006 | Whiteside | A63B 67/06 273/336 |
| 2016/0151692 | A1 * | 6/2016 | Rexwinkel | A63B 67/06 273/336 |
| 2016/0201885 | A1 * | 7/2016 | Rood | F21L 4/08 362/183 |

* cited by examiner

ILLUMINATING HUB ASSEMBLY FOR A QUOIT BOARD

CROSS REFERENCE TO RELATED APPLICATION

This application claims the benefit of U.S. Provisional Patent Application Ser. No. 62/622,329 filed on Jan. 26, 2018, the entirety of which is incorporated herein by reference.

FIELD OF THE INVENTION

The present invention relates generally to games of toss wherein a projectile is tossed at a target, and more particularly to ring toss games such as quoits, and more particularly still to a hub assembly for a quoit board having an illuminating center peg or pin.

BACKGROUND OF THE INVENTION

The game of quoits is a centuries old outdoor game that was brought to the Americas during colonial times. The earliest forms of quoits were similar to the present game of horseshoes, but with the players taking turns throwing metal rings at a stake about 20 feet away. While horseshoes continues to thrive in the United States, the original metal ring version of quoits has basically disappeared in most of the country. Several modified versions of quoits, however, remain popular in the eastern United States, particularly in central and eastern Pennsylvania and New Jersey. In the most popular modified version, which has been played in Pennsylvania for over 120 years, the metal rings have been replaced with rings made of hard rubber and weighing about one pound, while the ground stakes have been replaced with raised two-foot square boards preferably made of slate. In addition, a hub is provided including an aluminum or metal peg or pin which is secured extending upwardly from the center top of the board. A support, made of a durable material such as wood, is connected to the quoit board extending downwardly from the forward end of the board such that when the board is placed on a ground surface the playing face is raised and slanted or angled towards the players. Scoring rings are also provided on the face of the board spaced apart and extending concentrically outwardly from the pin. During play, two boards are set up facing each other about 18 ft. apart, and the players take turns tossing or pitching four rubber rings or quoits at a board. A cumulative scoring system based on the accuracy or results of the tosses is used to determine the winning player or team. Typically, a "ringer", or quoit that lands over the peg, is awarded three points; if there are no ringers or leaners, the closest quoit to the peg is awarded one point. The first player or team to reach twenty-one points is the winner.

The slate board version of quoits just described became popular in eastern Pennsylvania and New Jersey in large part because such area is the heart of the so-called "slate belt" of the United States, where large quantities of high-quality slate from which the quoit boards can be manufactured are readily available. Slate is a hard rock that naturally breaks into thin, smooth layers, and has a composition and structure that enables it to be easily cut into square pieces and then sanded to the proper texture. Slate quoit boards are also popular because slate has a consistency which when impacted by a hard rubber quoit deadens the impact, providing a characteristic thump when thrown properly, which sound is familiar and soothing to regular quoit players. Slate also has a surface friction which retards sliding of the quoits down the slanted surface of the board.

A drawback of slate quoit boards which hindered growth of the game outside of the "slate belt" is that it is prohibitively expensive to transport or ship pairs of slate quoit boards each weighing approximately 66 pounds even relatively short distances. In addition, while slate has properties that make it ideal for quoit boards, slate chips rather easily, so that greater-than-normal care in packaging and transporting the boards is required, further increasing the shipping costs. The present inventor therefore developed a quoit board which through a unique manufacturing process and method is made of a lighter, more durable plastic material, weighing less than 25 pounds, that also simulates the experience of using a slate quoit board. This board is the subject of U.S. Pat. No. 7,249,766 owned by the present inventor, and has helped to expand the popularity of quoits into areas where it was previously relatively unknown. Non-slate quoit boards made of other materials or combinations of materials, such as a wood board having a sheet-like plastic surface, are also now available.

Conventional quoits is intended to be played in a well-lit environment, with the light source being either natural daylight or an artificial light source, as otherwise the playing surface becomes difficult to see. Quoits is typically played at outdoor social gatherings such as Holiday picnics, family reunions, company events, and the like. Many outdoor social events, however, also take place or extend into the dusk or evening hours, and where an artificial light source is not available it would be desirable if quoits could be more easily played in such dimly lit environments. One possibility is to illuminate the outline of the board, or the scoring rings. It would be more desirable, however, if the central pin could be illuminated, since ultimately the central pin is the target the players are aiming at in attempting to throw "ringers", or in the event a ringer is not thrown, at least for their quoits to land on the board surface as close to the pin as possible. Illuminating the central pin is problematic, however, since the pin and hub structure and assembly must be sufficiently strong and durable to withstand the forces exerted on the pin and hub from being repeatedly struck by the heavy rubber quoits, which is why the pins are typically made of a hard metal material such as aluminum or brass. A further consideration is that the light source cannot be mounted to the quoit board in a manner that would disrupt or distract from normal game play, or in a position where the lights may be damaged by the thrown quoits. There is therefore a need for a hub assembly for a quoit board in which the center pin can be illuminated to facilitate play in dimly lit environments, that is sufficiently rugged and durable, and in which the light source is protected from damage.

BRIEF SUMMARY OF THE INVENTION

A hub assembly for a quoit board having a center pin that can be selectively illuminated thereby enabling the game to be played in dimly lit environments and which is also aesthetically pleasing. In an embodiment, the hub assembly includes a central pin formed of a translucent or transparent tubular member having a dome shaped end cap on one end, and a light element support provided on the opposite end. The light element support in an embodiment is comprised of a non-translucent rod-like member which is mounted in the interior of the tubular member, and at least one light element is mounted on the inwardly facing surface of the support, which light element is also electrically coupled to a power source such as a battery pack attached to the underside of the board. A base flange adapter is also provided, which includes a pin support section for supporting the tubular member or pin in an upright position to serve as a central pin for the quoit board, and a board connecting section. The pin support section includes an alignment burr on an interior surface of the support section against which the lower end of the tubular member is positioned. The adapter is secured to the underside of the quoit board to hold the pin in a use position. A cushioning member such as a gasket may also be positioned between the outer surface of the tubular member and the central aperture to absorb some of the forces exerted by the quoits on the illuminated central pin during game play.

Further areas of applicability of the present invention will become apparent from the detailed description provided hereinafter.

BRIEF DESCRIPTION OF THE DRAWINGS

The present invention will become more fully understood from the detailed description and the accompanying drawings, wherein.

DETAILED DESCRIPTION OF THE INVENTION

The following detailed description is of the best mode or modes of the invention presently contemplated. Such description is not intended to be understood in a limiting sense, but to be a non-limiting example of the invention presented solely for illustration thereof, and by reference to which in connection with the following description and the accompanying drawings one skilled in the art may be advised of the advantages and construction of the invention. Wherever possible, like reference numbers have been utilized to refer to like elements or features of the invention throughout the different embodiments illustrated herein.

Figure 1:
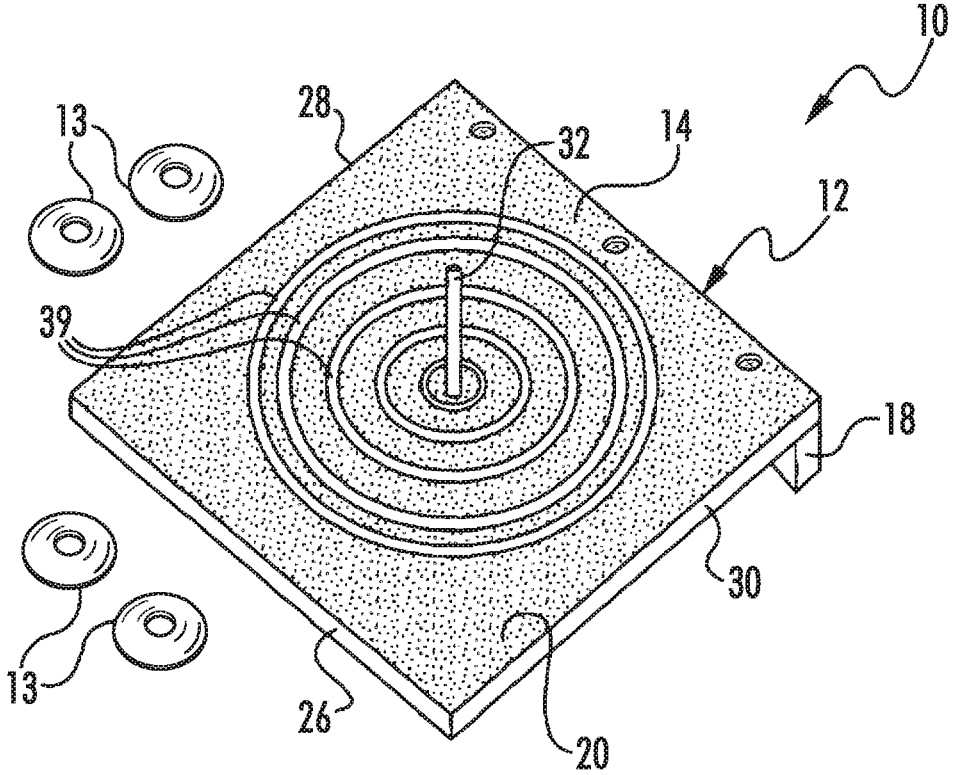
FIG. 1 is a perspective view of a quoit board having an illuminating hub according to an aspect of the present invention.
Figure 2:
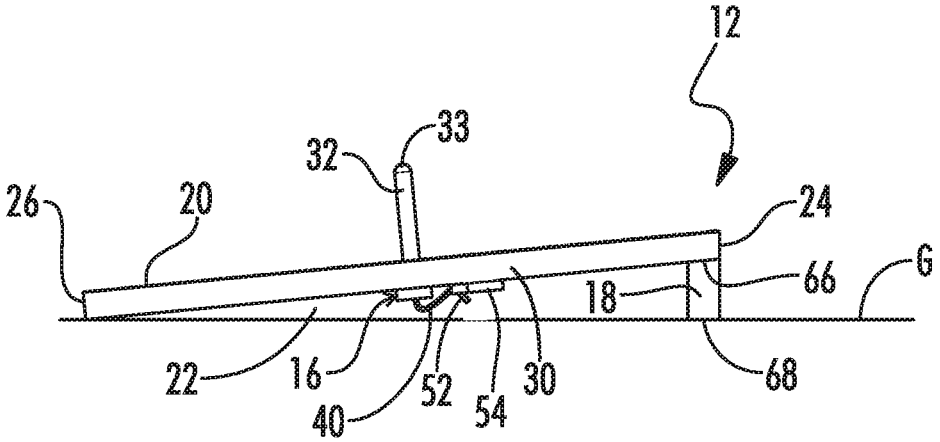
FIG. 2 is a side view of the quoit board shown in FIG. 1.

FIGS. 1 and 2 illustrate a quoit set 10 in accordance with the present invention, including a quoit board 12 (of which there are two in a typical set, but only one of which is shown in FIG. 1), and two sets of rubber quoits 13. Quoit board 12 is generally comprised of a board section 14, a hub assembly 16 (illustrated in greater detail in FIGS. 3 and 4) including an illuminating central peg or pin 32, and a board riser or support 18. Board section 14 generally has a square body which is defined by a top surface 20 that serves as the playing surface, a bottom surface or underside 22, a forward edge 24, a rearward edge 26, and side edges 28 and 30 each extending between top and bottom surfaces 20 and 22. Pin 32 includes a cylindrical section which when the hub assembly 16 is assembled is mounted in a central aperture in board section 14 extends upwardly from top surface 20, with a rounded or dome-shaped tip 33. Board support 18 is secured extending downwardly from the underside 22 of board section 14 along forward edge 24, such that the playing surface 20 of board 12 is elevated and disposed or angled forwardly toward the players. Scoring rings 39 formed as concentric grooves in top surface 20 of the board section 14 extend around the pin 32.

Board section 14 of quoit board 12 is made of slate, or in alternative embodiments may be made of a hard-plastic material such as polyethylene, polypropylene, polyurethane, or High-Density Polyethylene (HDPE), or a combination of materials including wood and plastic. In one embodiment, board support 18 is secured to the underside 22 of board section 14 along forward edge 24 by screws, bolts, or other suitable fasteners. As shown in FIG. 2, the upper edge 66 of board support 18 is cut at an angle to fit snugly against the underside 22 of board section 14 while its lower end 68 is flush with the ground surface G to provide a stable base, and ensures that the playing surface is at the desired angle during play.

Figure 3:
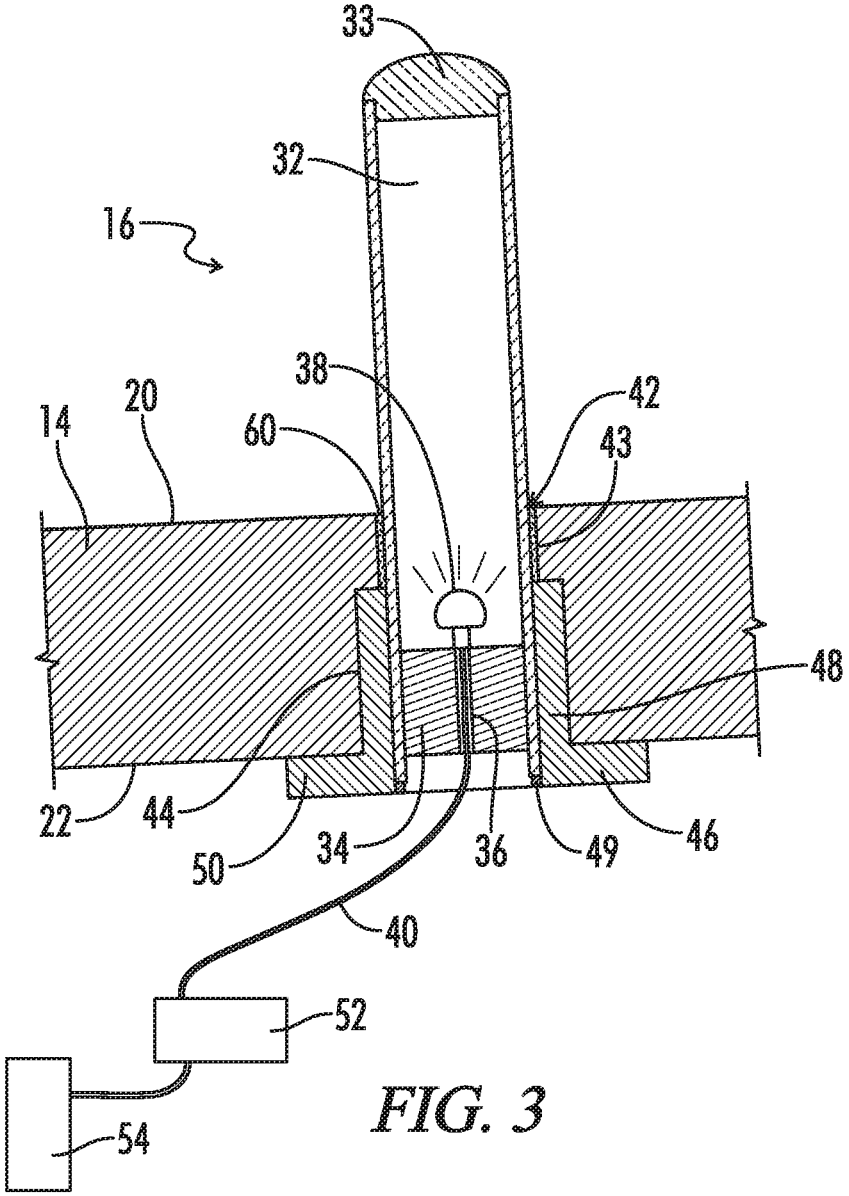
FIG. 3 is a side view of an embodiment of the hub assembly in accordance with the present invention.
Figure 4:
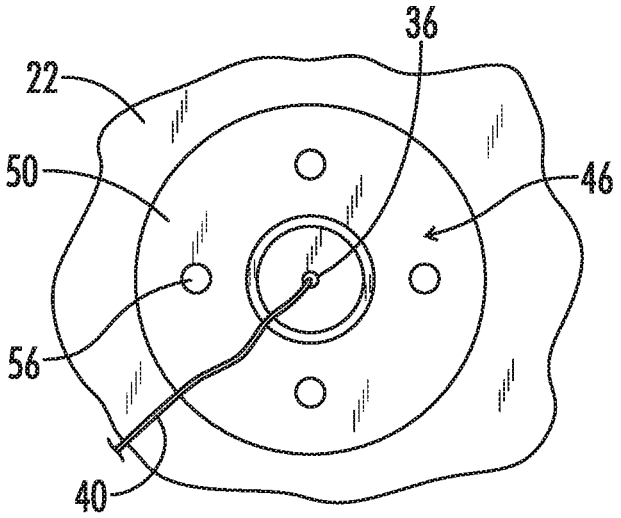
FIG. 4 is a bottom view of the hub assembly.

Referring now to FIGS. 3 and 4, hub assembly 16 includes a central pin 32 at which during game play the players taking turns pitching the quoits at the pin 32 in an attempt to score a "ringer, a light element support 34 for mounting at least one lighting element or fixture such as an LED (light emitting diode) light 38 in pin 32, and an adapter 44 for mounting the pin 32 to board section 14 of quoit board 12. LED light 38 is electrically coupled to a power source such as a battery pack 54, which may be secured to and retained on the underside 22 of the board section 14. Central pin 32 in the illustrated embodiment is comprised of a tubular member made of a transparent or translucent material, and in an embodiment is made of PVC plastic that has been cut to a length of about 5.5 inches, and having an outside diameter of about $^{13}/_{16}{}^{th}$ inches, and an inner diameter of about ½ inch. Pin 32 is rigid and will have a thickness and associated strength sufficient to withstand the forces of the one-pound rubber quoits being repeatedly tossed at the board section 14 over time in the usual course of game play. A rounded end cap 33 which is also preferably made of a transparent or translucent material is secured over the upper end of tubular pin 32. The outer surface or edge of cap 33 should be flush with the outer surface of the pin 32, and preferably cap 33 does not extend over an outer surface of the pin 32 as this will be evident when the pin is illuminated. The concave interior shape of cap 33 will optimize the light reflection from the lighting element in the tubular pin 32 and therefore the brightness of the central pin.

The light source or element is located on the hub assembly such that it can easily illuminate the entire pin 32, but also in position so that it is protected from being damaged during game play. In view thereof, a lighting element support 34, which in an embodiment may be a solid rod made of PVC plastic that may or may not be transparent or translucent, is dimensioned to have a diameter of just slightly less than about ½ round (or slightly less than the inner diameter of tubular pin 32), and is secured in the end of pin 32 opposite the end cap by a suitable means, such as by an adhesive. In an embodiment, support 34 has a length from end to end of about ½ inch, or less than the thickness of board section 14, and also includes a longitudinal hole 36, which hole 36 in an embodiment has a width of $^{1}/_{8}{}^{th}$ inches. LED light element 38 is then attached to an inwardly facing surface of the support 34 by a suitable means such as by an adhesive, while electrical wires 40 connected to the LED light 38 are passed through and out the lower end of the longitudinal hole 36 to be connected to a power source. In the illustrated embodiment, LED light 38 has a width of approximately ¼ inch, and may be any color such as white, red, or blue, and may be connected to a controller which can be programmed to cause the LED light to be turned on and off in response to a change in light intensity, blink, vary in intensity, or other controls. LED light 38 is positioned such that when activated, the tubular pin 32 and end cap 33 will be illuminated and visible by the players. In addition, when the hub assembly 16 is fully assembled, the LED light 38 will be positioned in central aperture 42 of the board section 14 attached to support 34 rather than directly connected to pin 32, both of which will aid in protecting the LED light 38 from being damaged during game play. A rubber gasket may be positioned between the support 34 and pin 32 to further isolate the support 34 and LED light 38 from the impacts of the quoits on pin 32 during game play.

To mount the hub assembly to board 12, the end of tubular pin 32 in which support 34 is mounted is inserted in central aperture 42 of board section 14. Aperture 42 includes an upper section 43 having a first diameter, and a lower section 44 having a second diameter that is greater than the first diameter. The lower section 44 of aperture 42 may be formed in a conventional manner such as by countersinking from lower surface 22. Also forming part of hub assembly 16 is base flange adapter 46, which may be custom machined and includes a tubular support section 48 and a base flange section 50 connected extending laterally on the lower end of the tubular support section 48. Tubular support section 48 is dimensioned to fit snugly in lower section 44 of the central aperture 42, and also has a diameter greater than the diameter of upper section 43 of aperture 42 such that it cannot pass upwardly into upper section 43. Base flange section 50 has a diameter greater than the diameter of lower section 44 of aperture 42, and therefore when support section 48 is inserted in lower section 44 of aperture 42 will abut against lower surface 22 of the board section 14.

The lower end of the tubular pin 32 is pushed downwardly into aperture 42 until it is positioned in lower section 44 and is surrounded by tubular section 48 of the base flange adapter 46. A flange 49 is provided, preferably by machining, extending outwardly from the inner surface of the tubular section 48 of the base flange adapter 46. Flange 49 prevents pin 32 from being completely passed downwardly through the tubular support section 48, and also serves as an alignment flange for the lower end of the pin 32 which is pushed downwardly into the tubular support section 48 of the base flange adapter 46 until it is pressing against flange 49, thus ensuring the proper vertical alignment of the pin 32. Wires 40 attached to LED light 38 are passed through the lower open end of tubular support section 48 of the base flange adapter 46, and in the illustrated embodiment are connected to an adapter 52 including an on/off switch and then to a power supply 54 which may be a battery pack. Several through-holes 56 are provided in base section 50 of the adapter 46 through which fasteners such as screws may be passed into the bottom surface 22 of the board section 14, securing the hub assembly 16 in position.

The lower end of tubular pin 32, support 34, and base flange 48 of adapter 46 are preferably permanently secured together such as by a permanent adhesive. In an embodiment, an adhesive may also be applied in central aperture 42 or on the portion of the outer surface of pin 32 which is secured in central aperture 42 or tubular support section 48 of the base flange adapter 46 to further secure the tubular member or pin 32 in position. In addition, a cushioning member 60 which may be a rubber gasket may be inserted in central aperture 42 near the top surface 20 of the board section 14 so as to be positioned between board section 14 and the outer surface of pin 32. Gasket 60 is provided to allow a slight flexing of the pin 32 with respect to the board section 14 upon being contacted by a quoit thrown at the board and contacting the tubular member or pin 32, which will further lessen the likelihood of the pin being damaged.

Base flange adapter 46 is formed of a solid material such as metal or a rigid plastic material. Adapter 46 must be strong enough to support the tubular member or pin 32 against movement as well as to withstand the forces of the quoits 13 being repeatedly thrown at the quoit board 12 and contacting the hub 16. The switch mechanism 52 and battery pack 54 for LED 38 are secured to the underside of board section 14 is a convenient location, such that the LED can be easily turned off and on as desired. The switch may also be connected in an embodiment to one or more LED rope lights extending around the periphery of board 14 or in the scoring rings 39, or alternatively a separate power source and switch for the scoring ring LED lights may be provided.

It will be evident that the illuminating hub assembly of the present invention provides both a functional structure component for a quoit board which enables the board game to be more readily played outdoors when the natural light has dimmed or also in dimly lit artificial environments, as well as an aesthetically pleasing light component, without interrupting or interfering with play of the game, and which is durable enough to prevent the light element or illuminating pin from being damaged by impacts from the heavy quoits.

While the present invention has been described at some length and with some particularity with respect to the several described embodiments, it is not intended that it should be limited to any such particulars or embodiments or any particular embodiment, but it is to be construed with references to the appended claims so as to provide the broadest possible interpretation of such claims in view of the prior art and, therefore, to effectively encompass the intended scope of the invention. As used throughout, ranges are used as shorthand for describing each and every value that is within the range. Any value within the range can be selected as the terminus of the range.

What is claimed is:

1. An illuminating hub assembly for a quoit board comprising:

a translucent or transparent tubular pin;

a light element support mounted in an end of the tubular pin;

an end cap secured over an opposite end of the tubular member, at least one light element mounted to the light element support and positioned in the tubular pin, said light element electrically coupled to a power source; and a base flange adapter having a support section for supporting the tubular pin in an upright position in a central aperture of the quoit board, an alignment flange on an interior surface of the support section against which an end of the tubular pin is abutted, and a base flange section connected to an end of the tubular support section, said base flange section having a width greater than the width of the central aperture.

2. An illuminating hub assembly for a quoit board as in claim 1 in which the quoit board central aperture additionally comprises an upper section having a first diameter, and a second section having a second diameter, said second section having a larger diameter than the first section.

3. An illuminating hub assembly for a quoit board as in claim 2 in which the end cap is translucent or transparent.

4. An illuminated hub assembly for a quoit board as in claim 3 in which the base section of the base flange adapter additionally includes a plurality of apertures through which fasteners are passed to secure the hub assembly to the board.

5. A combination quoit board and illuminating hub assembly comprising:

a quoit board having a board section and support section, the board section having a central aperture, the central aperture including an upper section having a first diameter, and a lower section having a second diameter, the second diameter being greater than the first diameter, a hub assembly including a tubular pin made of a translucent or transparent material, said tubular pin dimensioned to fit into the upper section of the central aperture, and a base flange adapter including a pin support section and a base flange section, the pin support section having an outside diameter dimensioned to extend into the lower section of the central aperture but not the upper section, and an alignment flange located on the inner surface of the pin support section against which an end of the tubular pin abuts when secured in the pin support section, and the base flange adapter being secured to a lower surface of the quoit board adjacent the central aperture, and at least one light element mounted in the tubular pin positioned in the central aperture when the hub assembly is secured to the quoit board, the light source electrically coupled to a power source retained by on quoit board.

6. The combination of claim 4, wherein said end cap is formed of a translucent or transparent material.

7. The combination of claim 5, additionally comprising a light support member mounted in the lower end of the tubular pin, said at least one light element mounted to the light support member, said light support member having a length of less than the thickness of the board section, and having an aperture formed extending longitudinally in which wires for electrically coupling the light source to said power source are received.

8. The combination of claim 6, wherein the at least one light source is an LED light.

9. The combination of claim 7, wherein the tubular section is made of PVC plastic and having a length of about 5.5 inches and an outer diameter of about $^{13}/_{16}{}^{th}$ inches.

10. The combination of claim 8 additionally comprising a cushioning member provided in the upper section of the central aperture between the board section and tubular member.

11. The combination of claim 9 additionally comprising a sensor switch electrically connected between the power source and the at least one light element, the sensor switch operable between an off position and an on position in response to a change in lighting intensity.

* * * * *